US011550253B2

(12) United States Patent
Yamamoto

(10) Patent No.: US 11,550,253 B2
(45) Date of Patent: Jan. 10, 2023

(54) IMAGE FORMING APPARATUS INCLUDING FIRST DRIVE TRANSMISSION PART AND SECOND DRIVE TRANSMISSION PART CONFIGURED TO TRANSMIT DRIVING FORCE FROM MOTOR

(71) Applicant: BROTHER KOGYO KABUSHIKI KAISHA, Nagoya (JP)

(72) Inventor: Koyo Yamamoto, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/375,506

(22) Filed: Jul. 14, 2021

(65) Prior Publication Data

US 2022/0026842 A1 Jan. 27, 2022

(30) Foreign Application Priority Data

Jul. 22, 2020 (JP) ..... JP2020-124930

(51) Int. Cl.
*G03G 15/00* (2006.01)
*G03G 21/16* (2006.01)

(52) U.S. Cl.
CPC ..... *G03G 15/757* (2013.01); *G03G 21/1647* (2013.01); *G03G 2221/1657* (2013.01)

(58) Field of Classification Search
CPC ..... G03G 15/757; G03G 21/1647; G03G 2221/1657
See application file for complete search history.

(56) References Cited

U.S. PATENT DOCUMENTS 6,125,253 A * 9/2000 Tashima ..... G03G 15/757 399/265
2009/0208242 A1* 8/2009 Hayakawa ..... G03G 21/1647 399/388
2013/0084096 A1 4/2013 Hashimoto
2020/0209781 A1 7/2020 Noda et al.

FOREIGN PATENT DOCUMENTS

JP 2005-162384 A 6/2005
JP 2013-76877 A 4/2013
JP 2020-109464 A 7/2020

* cited by examiner

*Primary Examiner* — Sandra Brase
(74) *Attorney, Agent, or Firm* — Merchant & Gould P.C.

(57) ABSTRACT

A first gear is arranged at an end of a first roller and rotatable together with the first roller. A second roller nips a sheet with the first roller and conveys the sheet to a print engine. The second roller is movable to change a distance between an axis of the first roller and an axis of the second roller. A second gear is arranged at an end of the second roller and rotatable together with the second roller. An urging member urges the second roller toward the first roller. A drive gear has gear teeth. The drive gear is rotatable by receiving driving force from a motor. A first drive transmission part transmits driving force from the drive gear to the first gear not through the second gear. A second drive transmission part transmits driving force from the drive gear to the second gear not through the first gear.

9 Claims, 11 Drawing Sheets

IMAGE FORMING APPARATUS INCLUDING FIRST DRIVE TRANSMISSION PART AND SECOND DRIVE TRANSMISSION PART CONFIGURED TO TRANSMIT DRIVING FORCE FROM MOTOR

CROSS REFERENCE TO RELATED APPLICATIONS

This application claims priority from Japanese Patent Application No. 2020-124930 filed Jul. 22, 2020. The entire content of the priority application is incorporated herein by reference.

TECHNICAL FIELD

This disclosure relates to an image forming apparatus.

BACKGROUND

Conventionally, an image forming apparatus including a roller that conveys a sheet to an image forming unit is known. This image forming apparatus is provided with a registration roller pair composed of a pair of registration rollers. In the registration roller pair, one registration roller is pressed against the other registration roller by a pressure spring. Gears are provided at the ends of the pair of registration rollers, and the two registration rollers are configured to rotate synchronously since the two gears engage each other.

SUMMARY

According to one aspect, this specification discloses an image forming apparatus. The image forming apparatus includes a print engine, a first roller, a first gear, a second roller, a second gear, an urging member, a motor, a drive gear, a first drive transmission part, and a second drive transmission part. The first gear is arranged at an end of the first roller and rotatable together with the first roller. The second roller is configured to nip a sheet with the first roller and to convey the sheet to the print engine. The second roller is movable so as to change a distance between an axis of the first roller and an axis of the second roller. The second gear is arranged at an end of the second roller and rotatable together with the second roller. The urging member is configured to urge the second roller toward the first roller. The drive gear has gear teeth. The drive gear is rotatable by receiving driving force from the motor. The first drive transmission part is configured to transmit driving force from the drive gear to the first gear not through the second gear. The second drive transmission part is configured to transmit driving force from the drive gear to the second gear not through the first gear.

BRIEF DESCRIPTION OF THE DRAWINGS

Embodiments in accordance with this disclosure will be described in detail with reference to the following figures wherein:

FIG. 8 is a perspective view showing a drive gear, a first gear, a second gear, a first idle gear, a second idle gear, and so on;

FIG. 11A shows a gear train of the present embodiment and FIG. 11B shows a gear train of a comparative example.

DETAILED DESCRIPTION

As described above, when a driving force is input to each roller by causing the gears arranged at each end of the pair of rollers to engage each other, each gear receives a reaction force in the radial direction from the other gear. Thus, in the pair of rollers, a force for sandwiching a sheet in a portion close to the gear becomes weak. In this way, when the contact pressure of the pair of rollers is non-uniform, a difference occurs in the conveyance speed of the sheet between a portion close to the gear and a portion far from the gear, which causes a problem that the sheet is skewed.

In view of the foregoing, an aspect of an objective of this disclosure is to suppress the skew of the sheet conveyed to the image forming unit.

Figure 1:
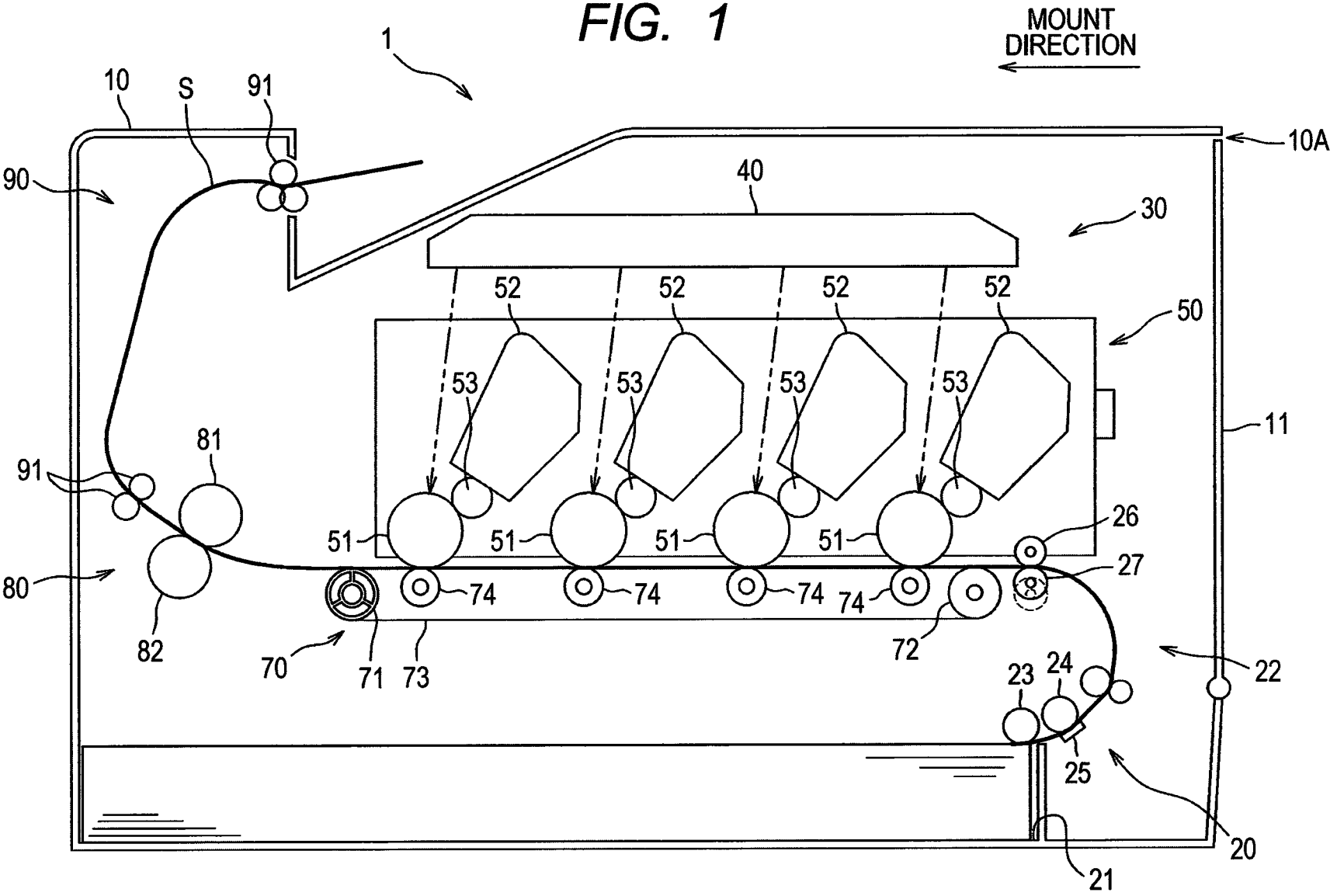
FIG. 1 is a diagram schematically showing an image forming apparatus according to an embodiment of this disclosure, and shows a state where a drawer is located in a main housing.

Next, an embodiment of this disclosure will be described in detail with reference to the attached drawings as appropriate. As shown in FIG. 1, an image forming apparatus 1 is a color printer, for example. The image forming apparatus 1 includes a main housing 10, a cover 11, a supply unit 20, an image forming unit 30 (an example of a print engine), and a discharge unit 90.

The main housing 10 has an opening 10A. A drawer 50 described later passes through the opening 10A when the drawer 50 enters the main housing 10. The cover 11 is movable between a closed position for closing the opening 10A shown in FIG. 1 and an open position for opening the opening 10A shown in FIG. 2.

The supply unit 20 is located at the lower part in the main housing 10. The supply unit 20 includes a sheet tray 21 for accommodating a sheet S and a supply mechanism 22 for supplying the sheet S from the sheet tray 21 to the image forming unit 30. The sheet tray 21 is configured to be detachable by being pulled out from the main housing 10. The supply mechanism 22 includes a supply roller 23, a separation roller 24, a separation pad 25, a first roller 26, and a second roller 27. The sheet S is a medium on which the image forming apparatus 1 forms an image, and includes plain paper, envelopes, postcards, thin paper, thick paper, glossy paper, resin sheets, stickers, and so on.

In the supply unit 20, after the sheet S in the sheet tray 21 is sent out by the supply roller 23, the sheet S is separated one sheet at a time between the separation roller 24 and the separation pad 25. After that, the leading end position of the sheet S is regulated by the first roller 26 and the second roller 27 in a state where the rotation is stopped, and then the first roller 26 and the second roller 27 rotate so that the sheet S is supplied to the image forming unit 30. The first roller 26 and the second roller 27 serve as a pair of registration rollers.

A driving force is input to each of the first roller 26 and the second roller 27. The first roller 26 is provided at the drawer 50. The second roller 27 is provided at the main housing 10 (see FIG. 2). In a state where the drawer 50 is mounted on the main housing 10, the first roller 26 faces the second roller 27 and is contactable with the second roller 27.

The image forming unit 30 forms an image on the sheet S. The image forming unit 30 includes a scanner unit 40, the drawer 50, a transfer unit 70, and a fixing unit 80.

The scanner unit 40 is provided in the upper part of the main housing 10 and includes a laser emitting portion, a polygon mirror, a lens, a reflecting mirror, and so on (not shown). A laser beam is emitted from the scanner unit 40, and is irradiated on the surface of each photosensitive drum 51 of the drawer 50 by high-speed scanning through the path shown by the double-dot chains line in FIG. 1.

Figure 2:
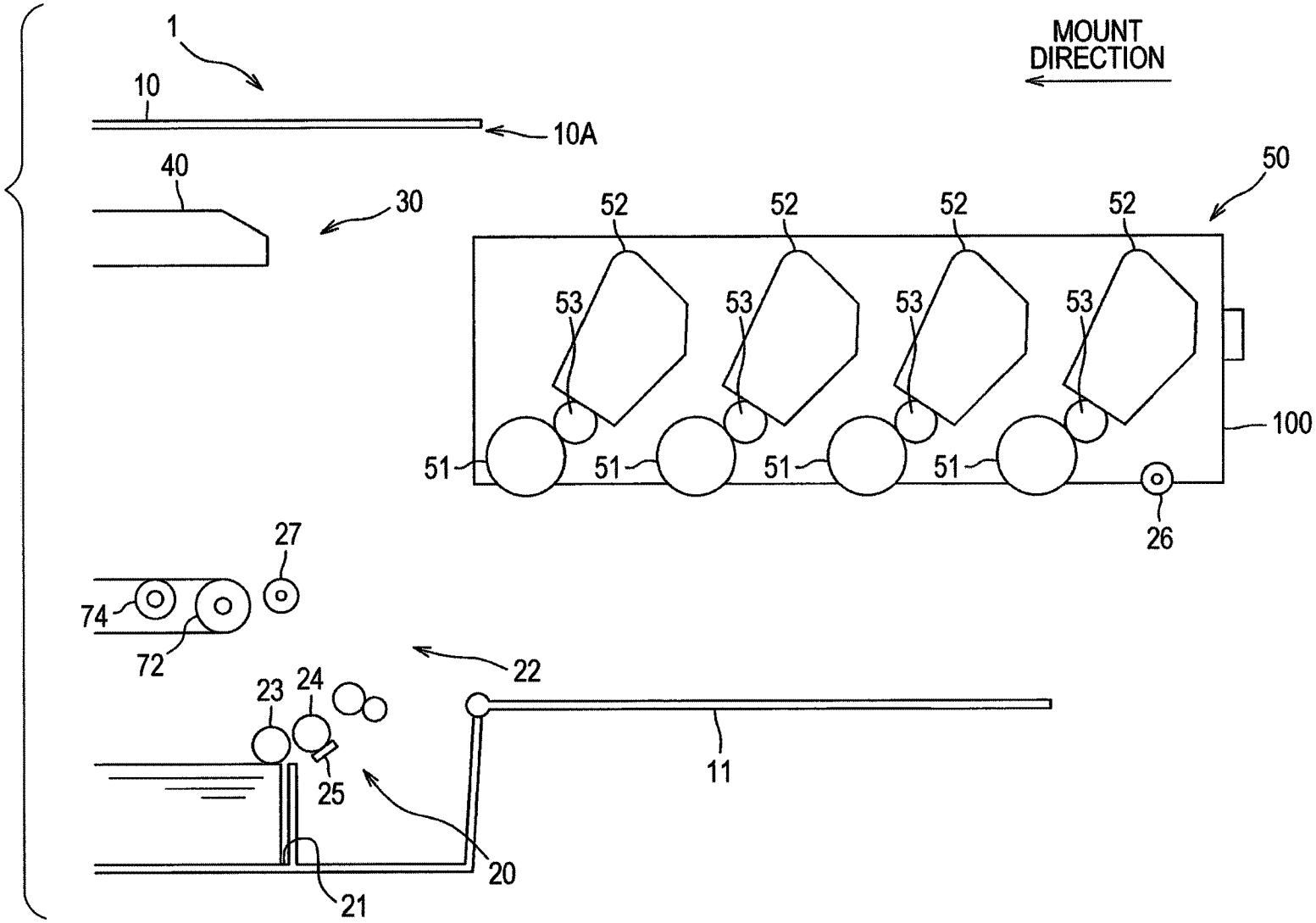
FIG. 2 is a diagram showing a state where the drawer is located outside the main housing.

The drawer 50 is movable between a first position inside the main housing 10 (the position shown in FIG. 1) and a second position outside the main housing 10 (the position shown in FIG. 2). Specifically, in a state where the cover 11 is located at the open position, the drawer 50 is attachable (mountable) to or detachable from the main housing 10 through the opening 10A. The drawer 50 includes four photosensitive drums 51 and four development cartridges 52.

Each photosensitive drum 51 is supported so as to be rotatable about a rotation axis extending in the axial direction. In the following description, the axial direction of the photosensitive drum 51 is simply referred to as "axial direction". The axial direction of the photosensitive drum 51 is the same as the axial direction of a drive gear G3 described later. The photosensitive drums 51 are arranged in the direction in which the drawer 50 is mounted to the main housing 10 (in the following description, simply referred to as "mount direction"). In addition to the photosensitive drum 51, the drawer 50 is provided with a charger and so on (not shown).

The development cartridge 52 is attachable to and detachable from the drawer 50 relative to each photosensitive drum 51. The development cartridge 52 is provided with a development roller 53 that supplies toner to the photosensitive drum 51, a toner accommodating chamber, a supply roller, and so on (not shown).

The transfer unit 70 is provided between the supply unit 20 and the drawer 50, and includes a drive roller 71, a follow roller 72, a conveyance belt 73, and transfer rollers 74.

The drive roller 71 and the follow roller 72 are arranged apart from each other in the mount direction, and the conveyance belt 73 formed of an endless belt is stretched between the rollers 71 and 72. The outer surface of the conveyance belt 73 is in contact with the photosensitive drums 51. Four transfer rollers 74 that sandwich the conveyance belt 73 with the photosensitive drums 51 are arranged inside the conveyance belt 73.

The fixing unit 80 is arranged between the drawer 50 and the discharge unit 90. The fixing unit 80 includes a heating roller 81 and a pressure roller 82. The pressure roller 82 is provided so as to face the heating roller 81 and is pressed against the heating roller 81.

In the image forming unit 30 configured in this way, first, the surface of each photosensitive drum 51 is uniformly charged by the charger, and then exposed by the scanner unit 40. As a result, the potential of the exposed portion is lowered, and an electrostatic latent image based on image data is formed on each photosensitive drum 51. After that, the toner in the development cartridge 52 is supplied to the electrostatic latent image on the photosensitive drum 51 by the development roller 53, so that a toner image is borne on the photosensitive drum 51.

Next, the sheet S supplied on the conveyance belt 73 passes between each photosensitive drum 51 and each transfer roller 74, so that the toner image formed on each photosensitive drum 51 is transferred onto the sheet S. Then, as the sheet S passes between the heating roller 81 and the pressure roller 82, the toner image transferred onto the sheet S is thermally fixed.

The discharge unit 90 discharges the sheet S on which the image is formed. The discharge unit 90 includes a plurality of conveyance rollers 91 for conveying the sheet S. The sheet S to which the toner image is transferred and thermally fixed is conveyed by the conveyance rollers 91 and discharged to the outside of the main housing 10.

Next, a configuration in which the drawer 50 is positioned relative to the main housing 10 will be described. The drawer 50 is mounted inside the main housing 10, and when the cover 11 is closed, the drawer 50 is positioned relative to the main housing 10. The drawer 50 is positioned at two positions, that is, the rear side (the downstream side in the mount direction) and the front side (the upstream side in the mount direction).

First, positioning at the rear side of the drawer 50 will be described.

Figure 3:
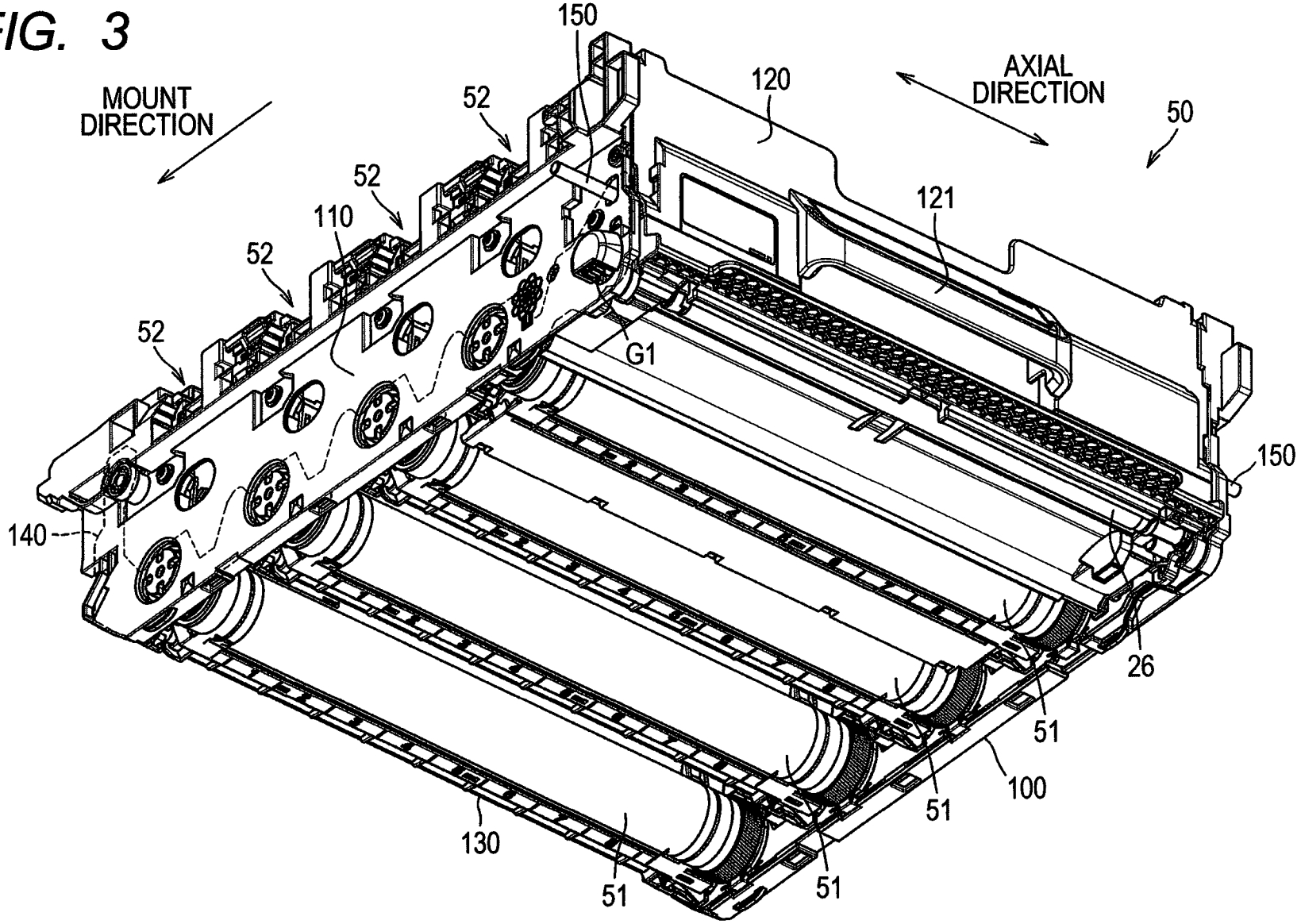
FIG. 3 is a perspective view of the drawer as viewed from below.

As shown in FIG. 3, the drawer 50 is formed in a rectangular frame shape, and four photosensitive drums 51 and four development cartridges 52 are held side by side in the mount direction inside the drawer 50.

Specifically, the drawer 50 includes a pair of side walls 110, a first beam 120 connecting one ends of the pair of side walls 110, a second beam 130 connecting the other ends of the pair of side walls 110, a pair of sheet metals 140, and a shaft 150.

The first beam 120 is provided with a handle 121 and a first roller 26. The handle 121 is provided on the outer surface of the first beam 120. With this configuration, the user can move the drawer 50 between the first position and the second position by grasping the handle 121. The first roller 26 is located below the first beam 120.

Figure 4:
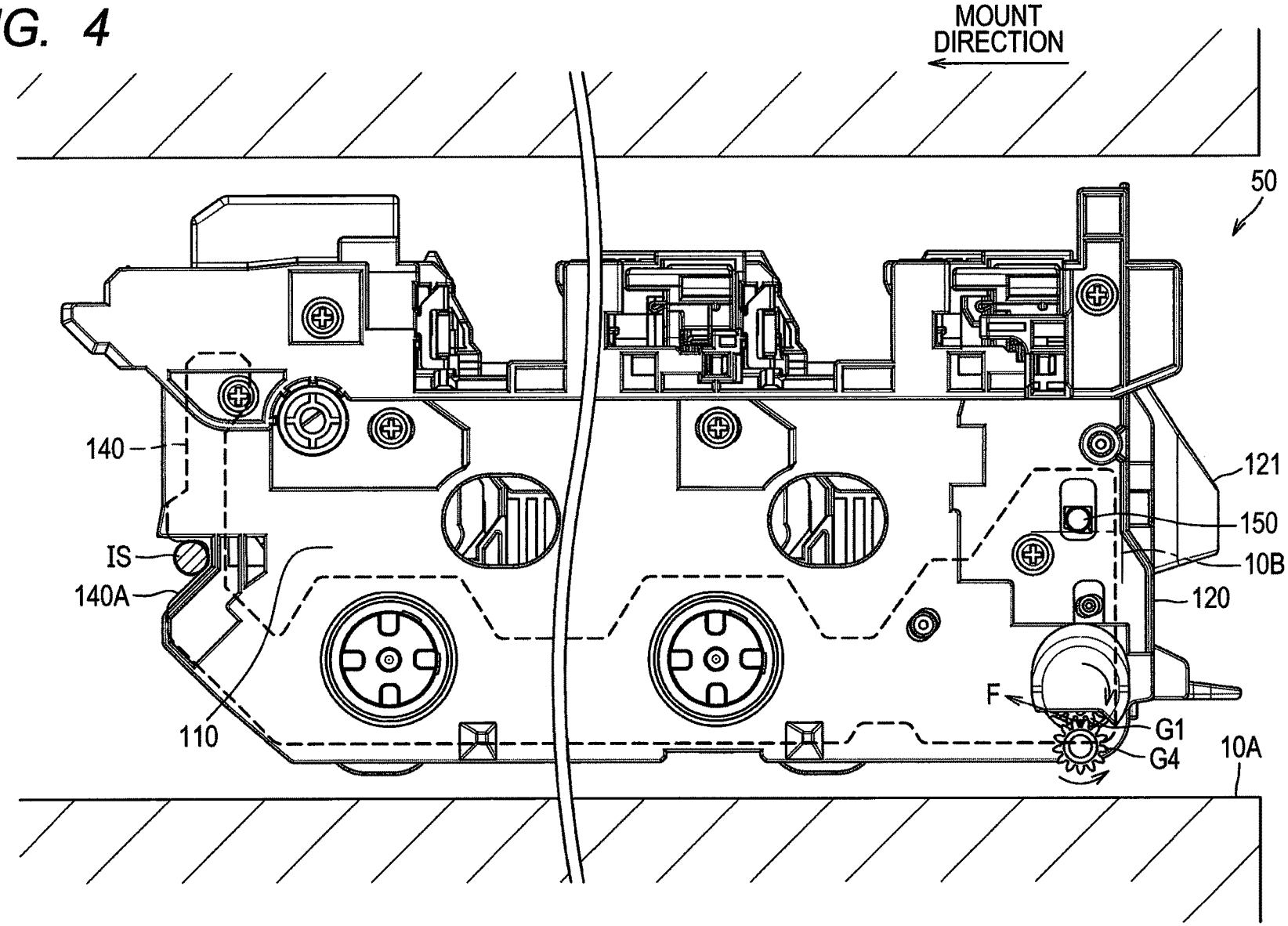
FIG. 4 is a diagram showing the drawer as viewed from an axial direction.

As shown by the broken lines in FIGS. 3 and 4, the pair of sheet metals 140 is metal plates long in the mount direction. The pair of sheet metals 140 is arranged inside the pair of side walls 110, respectively, and rotatably supports the four photosensitive drums 51. The pair of sheet metals 140 has a symmetrical shape with respect to the left-right direction (the axial direction), and only the sheet metal 140 at one side is shown in FIGS. 3 and 4.

As shown in FIG. 4, the pair of sheet metals 140 has a cutout 140A at the edge on the rear side (the downstream side in the mount direction). On the other hand, the main housing 10 is provided with a positioning shaft IS extending in the axial direction. The cutout 140A contacts the positioning shaft IS of the main housing 10 when the drawer 50 is mounted in the main housing 10. When the cutout 140A of the sheet metal 140 contacts the positioning shaft IS, the rear-side portion of the drawer 50 is positioned in the vertical direction and the mount direction.

Next, the positioning of the drawer 50 at the front side will be described.

As shown in FIG. 3, the shaft 150 extends in the axial direction. Both ends of the shaft 150 protrude outward from the pair of side walls 110. The shaft 150 is fixed to the pair of sheet metals 140 of the drawer 50. In a state where the drawer 50 is located at the first position, the shaft 150 is placed on a support base 10B of the main housing 10. Thus, the front-side portion of the drawer 50 is positioned in the vertical direction.

Figure 5:
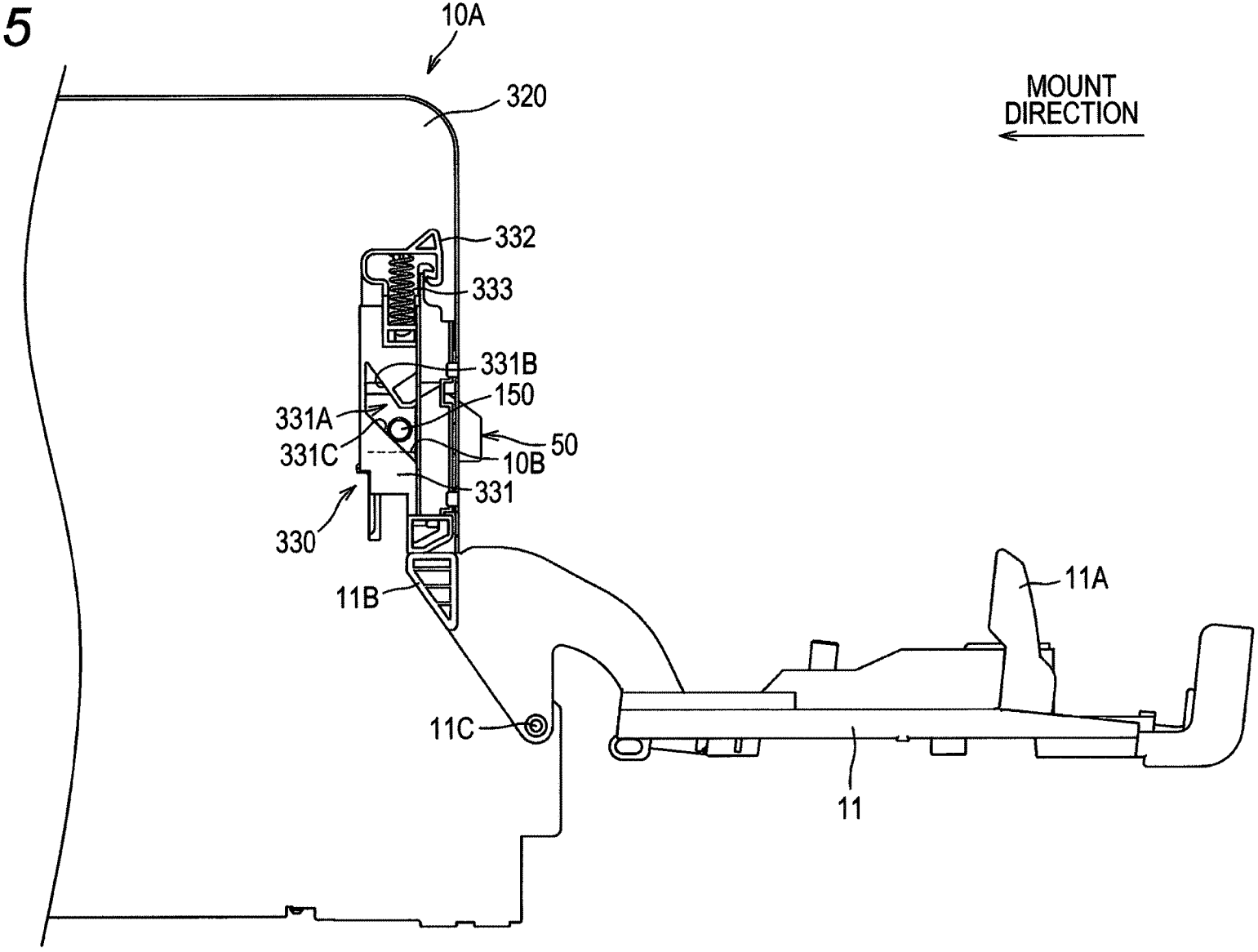
FIG. 5 is a diagram showing the periphery of a pressing member in a state where a cover is open.

As shown in FIG. 5, the main housing 10 includes a pair of side frames 320 and a translation cam (linear moving cam) 330. The pair of side frames 320 is arranged outside the drawer 50 in the axial direction. A guide (not shown) for guiding the mounting of the drawer 50 is formed inside the pair of side frames 320 in the axial direction.

The translation cam 330 has a base member 331, a slide member 332, and a coil spring 333. The base member 331 is attached to the side frame 320 and is slidable up and down relative to the side frame 320. The slide member 332 is attached to the upper side of the base member 331 and is slidable up and down relative to the base member 331. The coil spring 333 is attached to the slide member 332, and has one end in contact with the base member 331 and the other end in contact with the slide member 332. The coil spring 333 constantly urges the slide member 332 upward.

The base member 331 has a cutout groove 331A. The cutout groove 331A extends from the opening 10A to the rear side (the downstream side in the mount direction). The cutout groove 331A allows the shaft 150 to enter therein when the drawer 50 is mounted on the main housing 10. The cutout groove 331A has a first inclined surface 331B and a second inclined surface 331C. The first inclined surface 331B is inclined to be higher toward the rear side (the downstream side in the mount direction). The first inclined surface 331B faces diagonally downward. The second inclined surface 331C is located below the first inclined surface 331B and extends substantially in parallel to the first inclined surface 331B. The second inclined surface 331C faces diagonally upward.

The cover 11 has a first pressing portion 11A, a second pressing portion 11B, and a rotation shaft 11C.

The first pressing portion 11A is located outside the opening 10A when the cover 11 is opened, and protrudes to enter the opening 10A when the cover 11 is closed. In the closed state of the cover 11, the first pressing portion 11A is located at a higher position than the rotation shaft 11C.

The second pressing portion 11B is arranged to be located at a higher position than the rotation shaft 11C when the cover 11 is opened and be located at a lower position than the rotation shaft 11C when the cover 11 is closed.

As shown in FIG. 5, when the cover 11 is opened, the second pressing portion 11B contacts the translation cam 330 and pushes up the same from below. Then, the first inclined surface 331B separates upward from the shaft 150. As a result, the drawer 50 can be pulled out from the main housing 10.

Figure 6B:
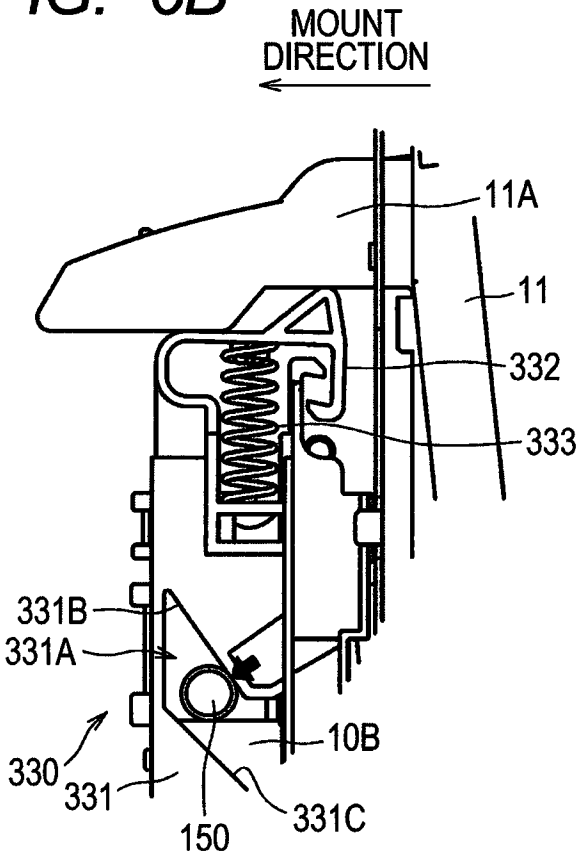
FIG. 6B is a diagram illustrating an operation in which the pressing member presses a shaft.
Figure 6A:
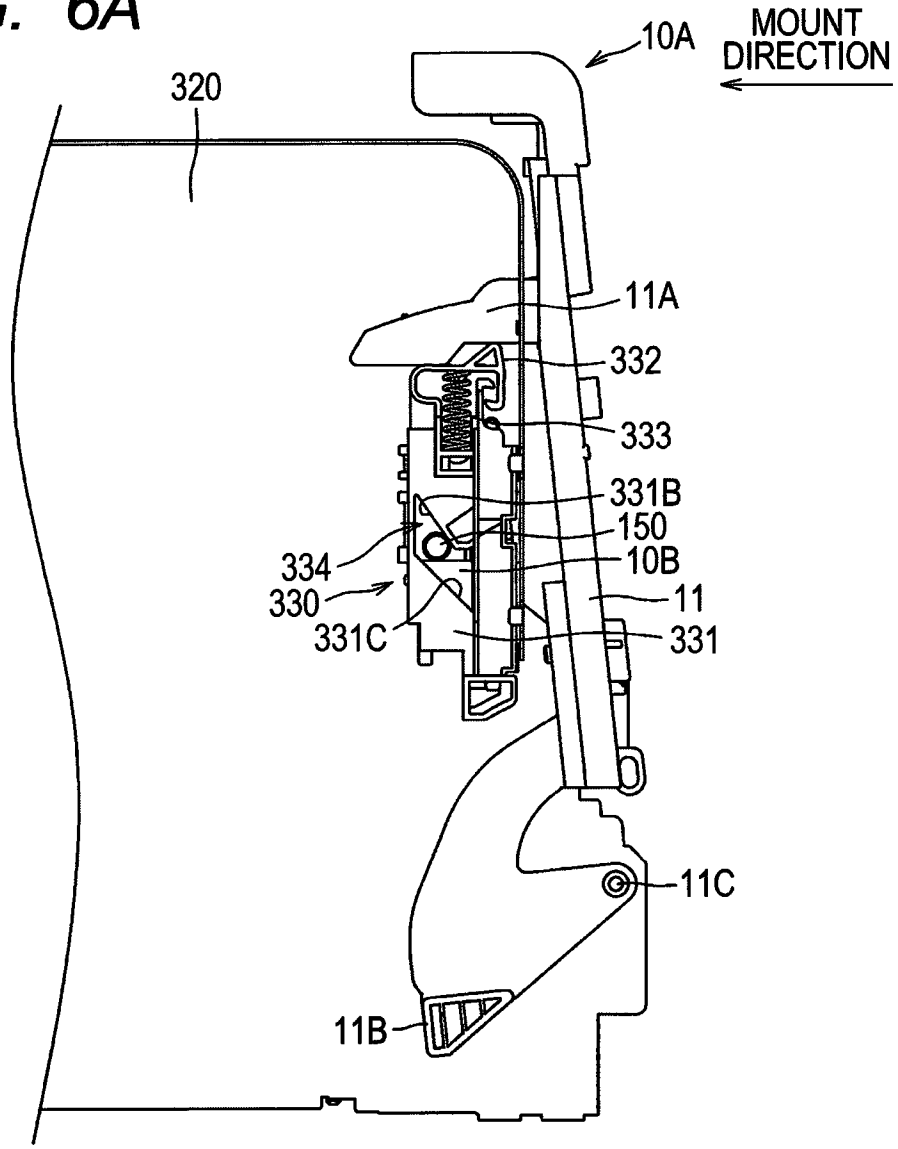
FIG. 6A is a diagram showing the periphery of the pressing member in a state where the cover is closed.

As shown in FIGS. 6A and 6B, when the cover 11 is closed, the first pressing portion 11A contacts the slide member 332 and pushes the slide member 332 downward. Then, the slide member 332 pushes the base member 331 downward. When the base member 331 slides downward, the first inclined surface 331B contacts the shaft 150, and the first inclined surface 331B presses the shaft 150 downward and rearward (toward the downstream side in the mount direction).

When the cover 11 is closed in this way, the drawer 50 is urged downward and rearward (toward the downstream side in the mount direction). Thus, the cutout 140A of the sheet metal 140 firmly contacts the positioning shaft IS and is positioned in the mount direction and the vertical direction, and the shaft 150 firmly contacts the support base 10B and is positioned in the vertical direction.

Next, a configuration for driving the first roller 26 and the second roller 27 will be described.

Figure 7:
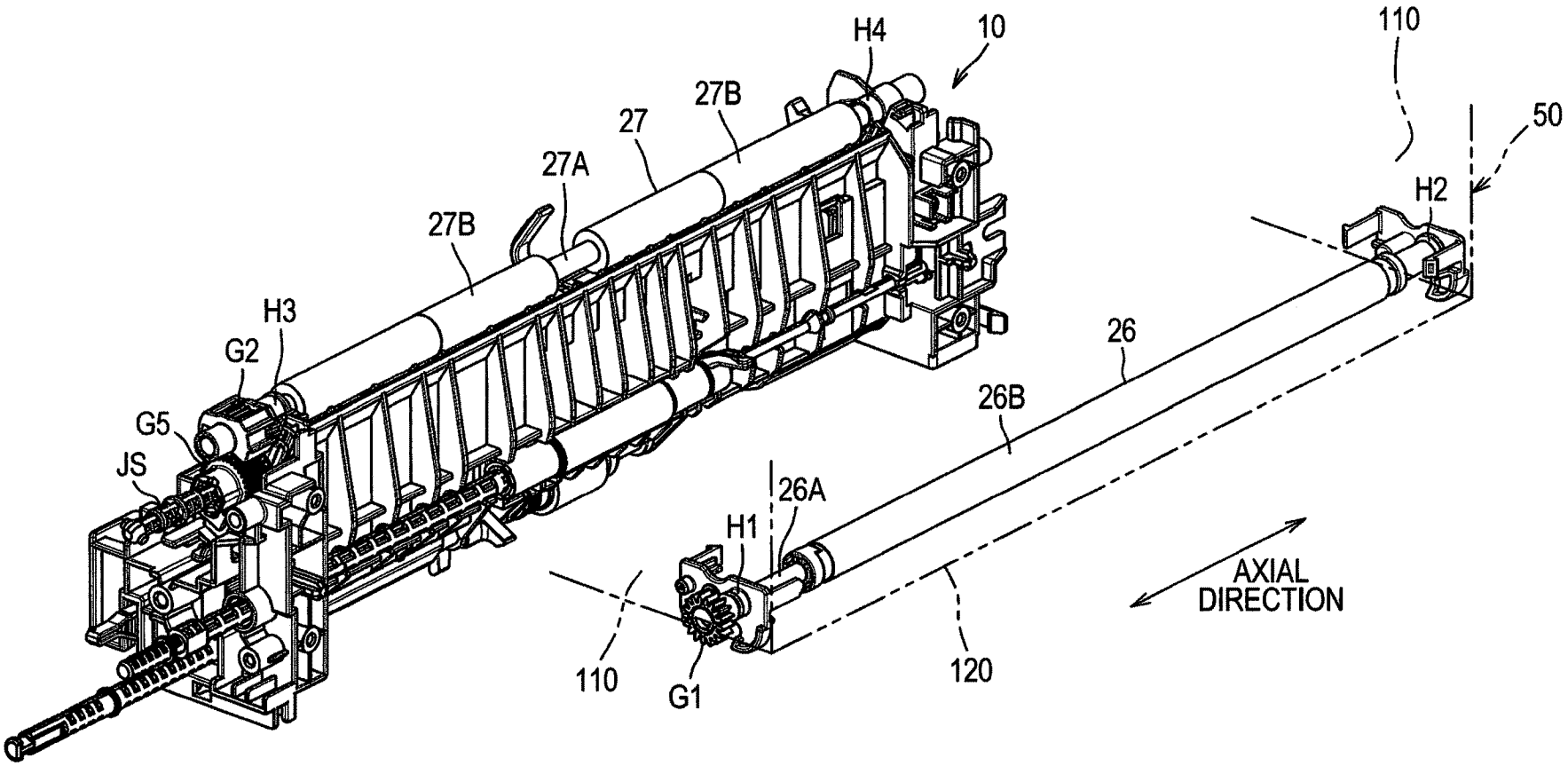
FIG. 7 is a perspective view illustrating a first roller, a second roller, and a member supporting the first roller and the second roller.

As shown in FIG. 7, the first roller 26 has a shaft 26A and a roller portion 26B. The roller portion 26B is a portion for nipping the sheet S between the roller portion 26B and the second roller 27.

The drawer 50 further includes a pair of bearings H1 and H2. The pair of bearings H1 and H2 rotatably supports the first roller 26.

The second roller 27 has a shaft 27A and roller portions 27B. The roller portions 27B are portions for nipping the sheet S between the roller portions 27B and the first rollers 26. In the present embodiment, the roller portions 27B are divided into two parts in the axial direction, but the roller portion 27B may be an integral part or may be divided into three or more parts.

Figure 11A:
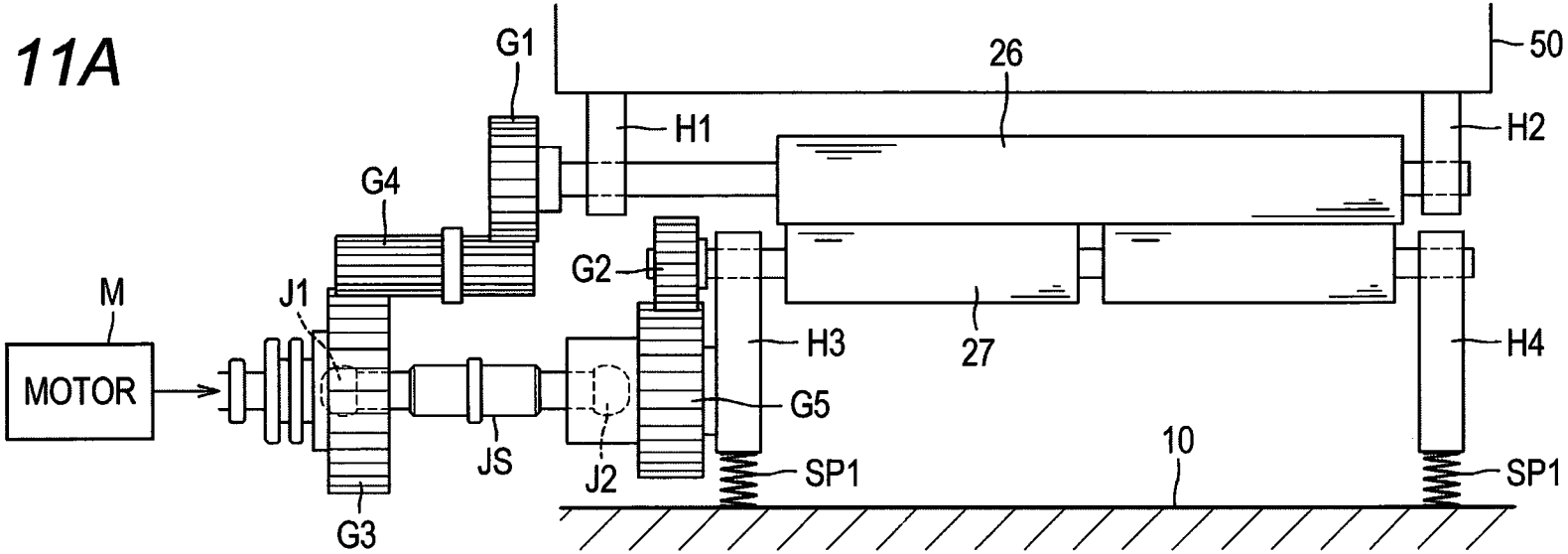
FIGS. 11A and 11B are diagrams for explaining the operation and effect of the present embodiment, where

The main housing 10 further includes a pair of bearings H3 and H4 that rotatably support the second roller 27, and a pair of urging members SP1 (see FIG. 11A). Since the pair of bearings H3 and H4 have the same configuration that supports the second roller 27, only a bearing H3 will be described here.

Figure 9:
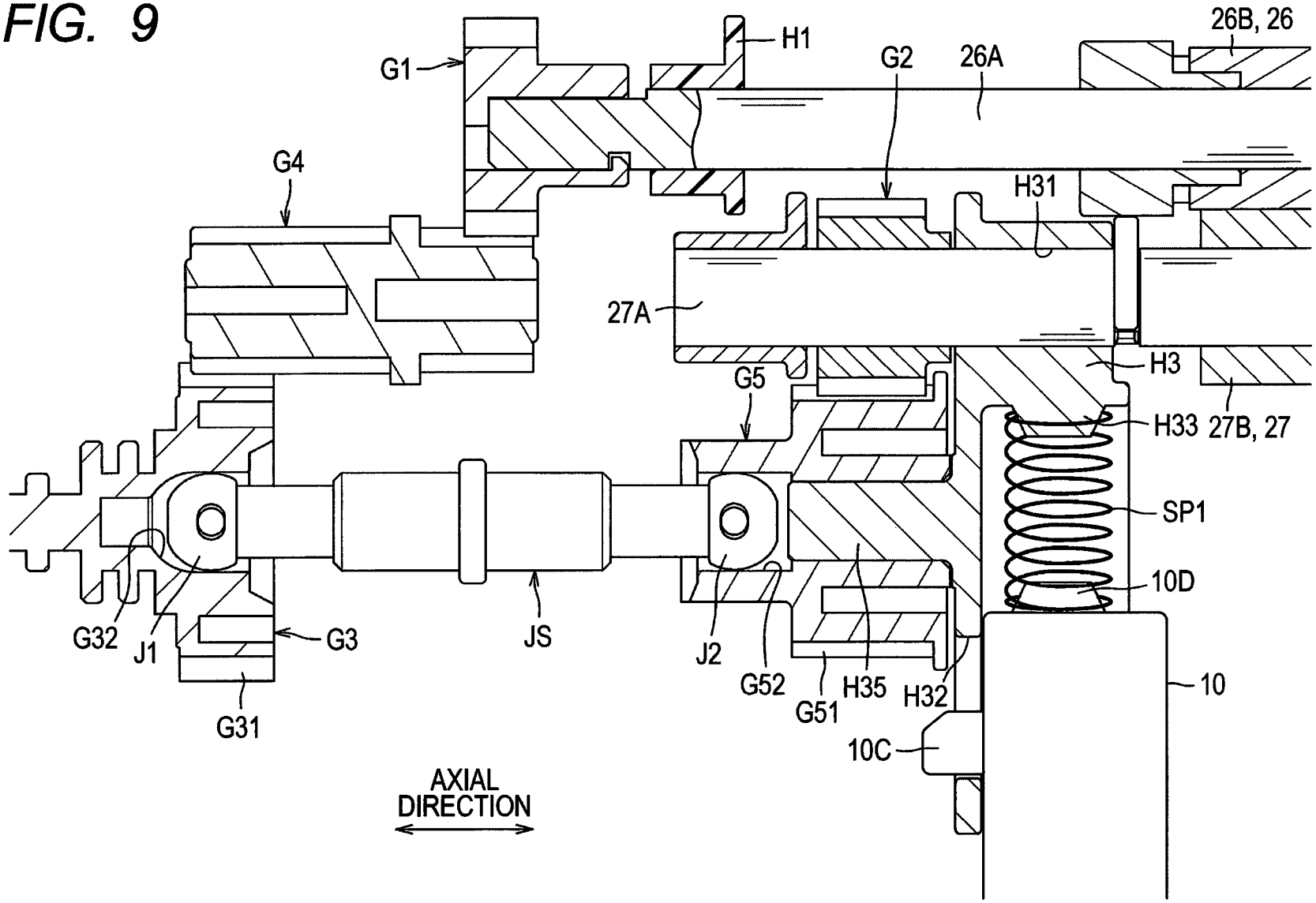
FIG. 9 is a cross-sectional view showing a gear train in a state where the first roller and the second roller are in contact with each other.

As shown in FIG. 9, the bearing H3 has a shaft hole H31, an elongated hole H32, and a spring receiving portion H33.

The shaft hole H31 rotatably supports the shaft 27A of the second roller 27. The elongated hole H32 extends in a direction connecting the axis of the first roller 26 and the axis of the second roller 27. The main housing 10 has a protrusion 10C that enters the elongated hole H32. The bearing H3 moves in the longitudinal direction of the elongated hole H32 relative to the protrusion 10C in a state where the protrusion 10C is engaged with the elongated hole H32. That is, the bearing H3 is movable in the direction between the axis of the first roller 26 and the axis of the second roller 27. As a result, the second roller 27 is movable so as to change the distance between the axis of the first roller 26 and the axis of the second roller 27 (see also FIG. 1).

The spring receiving portion H33 is a protrusion protruding downward. The spring receiving portion H33 receives the upper end of the urging member SP1. The main housing 10 has a spring receiving portion 10D protruding upward. The spring receiving portion 10D receives the lower end of the urging member SP1.

The urging member SP1 is a compression spring and is arranged between the spring receiving portion H33 and the main housing 10. The urging member SP1 constantly urges the bearing H3 upward. As a result, the second roller 27 is constantly urged toward the first roller 26. The urging member SP1 may by another urging member such as rubber and elastic material.

Unlike the bearing H4, the bearing H3 rotatably supports a first idle gear G5. The bearing H3 has a shaft portion H35 protruding in the axial direction. The shaft portion H35 rotatably supports the first idle gear G5, which will be described later. That is, the bearing H3 is an example of a gear holder that holds a second gear G2 and the first idle gear G5 and is movable relative to the first roller 26.

Figure 8:
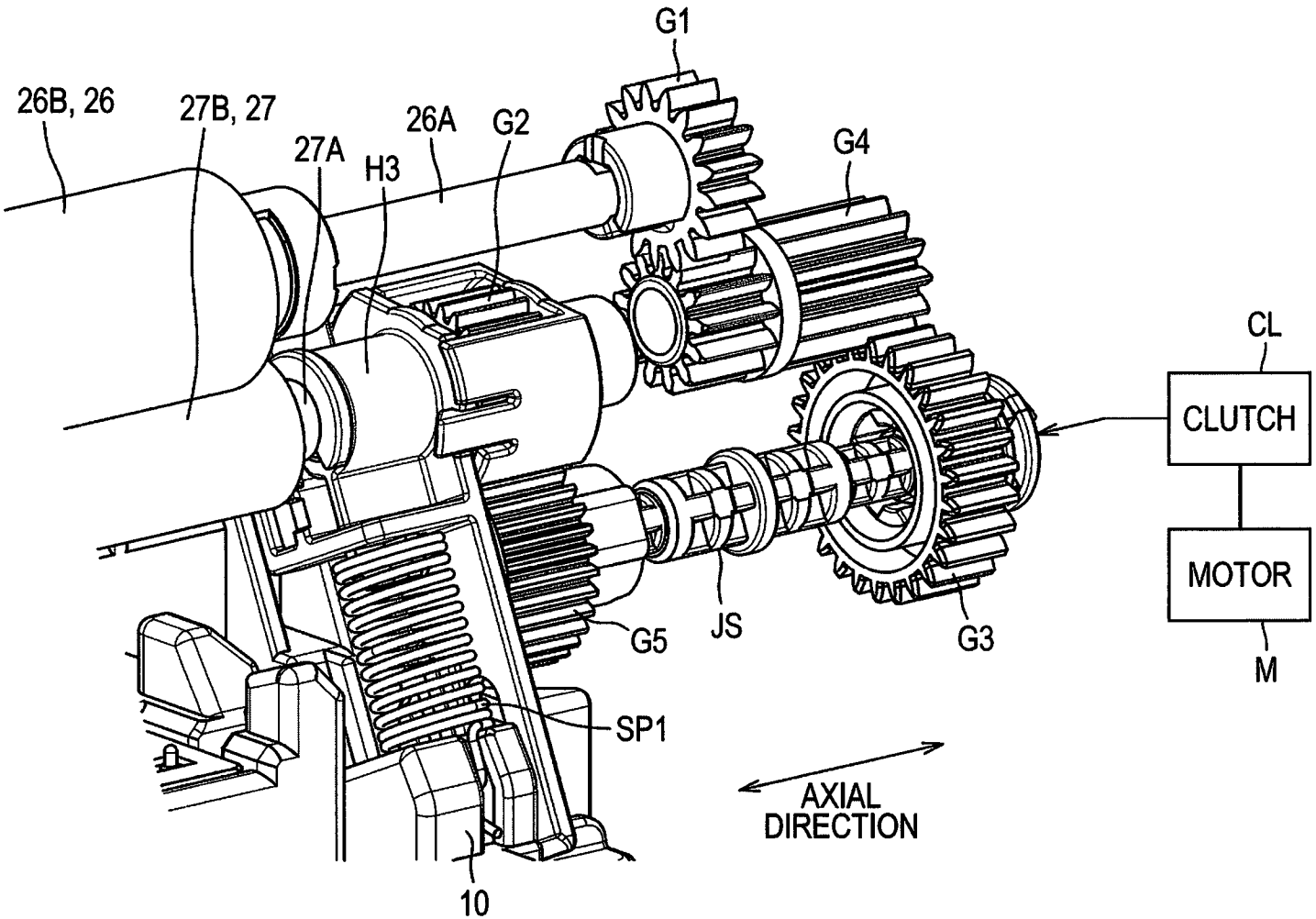

As shown in FIGS. 7 and 8, the image forming apparatus 1 includes a first gear G1, the second gear G2, a motor M, a clutch CL, the drive gear G3, a first drive transmission part, and a second drive transmission part.

The first gear G1 is arranged at an end of the first roller 26 and rotates integrally with the first roller 26. As shown in FIG. 9, the first gear G1 is located between the drive gear G3 and the second gear G2 in the axial direction of the drive gear G3. Further, one bearing H1 that supports the first roller 26 is located between the first gear G1 and the roller portion 26B of the first roller 26 in the axial direction of the drive gear G3.

The second gear G2 is arranged at an end of the second roller 27 and rotates integrally with the second roller 27.

The drive gear G3 rotates by receiving a driving force from the motor M through the clutch CL (see FIG. 8). The drive gear G3 has gear teeth G31 and a first recess G32. One end J1 of a joint shaft JS described later fits in the first recess G32.

The first drive transmission part transmits the driving force of the drive gear G3 to the first gear G1. The first drive transmission part transmits the driving force from the drive gear G3 to the first gear G1 not through the second gear G2. In the present embodiment, the first drive transmission part has a second idle gear G4 that directly engages the first gear G1. That is, the second idle gear G4 directly engages the first gear G1 and the drive gear G3.

As shown in FIG. 4, the second idle gear G4 is located below the first gear G1. Thus, when the second idle gear G4 rotates in the direction of the arrow in FIG. 4 (counterclockwise), the second idle gear G4 pushes the first gear G1 toward the left side in FIG. 4 (rearward or toward the downstream side in the mount direction). In other words, the second idle gear G4 urges the drawer 50 in the direction opposite the opening 10A when transmitting the driving force to the first gear G1.

As shown in FIG. 9, the second drive transmission part transmits the driving force of the drive gear G3 to the second gear G2. The second drive transmission part transmits the driving force from the drive gear G3 to the second gear G2 not through the first gear G1. In the present embodiment, the second drive transmission part has a first idle gear G5, the joint shaft JS, and the bearing H3 as a gear holder.

The first idle gear G5 has gear teeth G51 that engages the second gear G2 and a second recess G52.

The joint shaft JS is a shaft extending in the axial direction, and has ends J1 and J2 forming a universal joint at both ends.

The one end J1 fits in the first recess G32 of the drive gear G3 and is connected to the drive gear G3. As a result, the one end J1 forms a universal joint together with the first recess G32. Further, the one end J1 is located inside the gear teeth G31 of the drive gear G3 in the radial direction.

Figure 10:
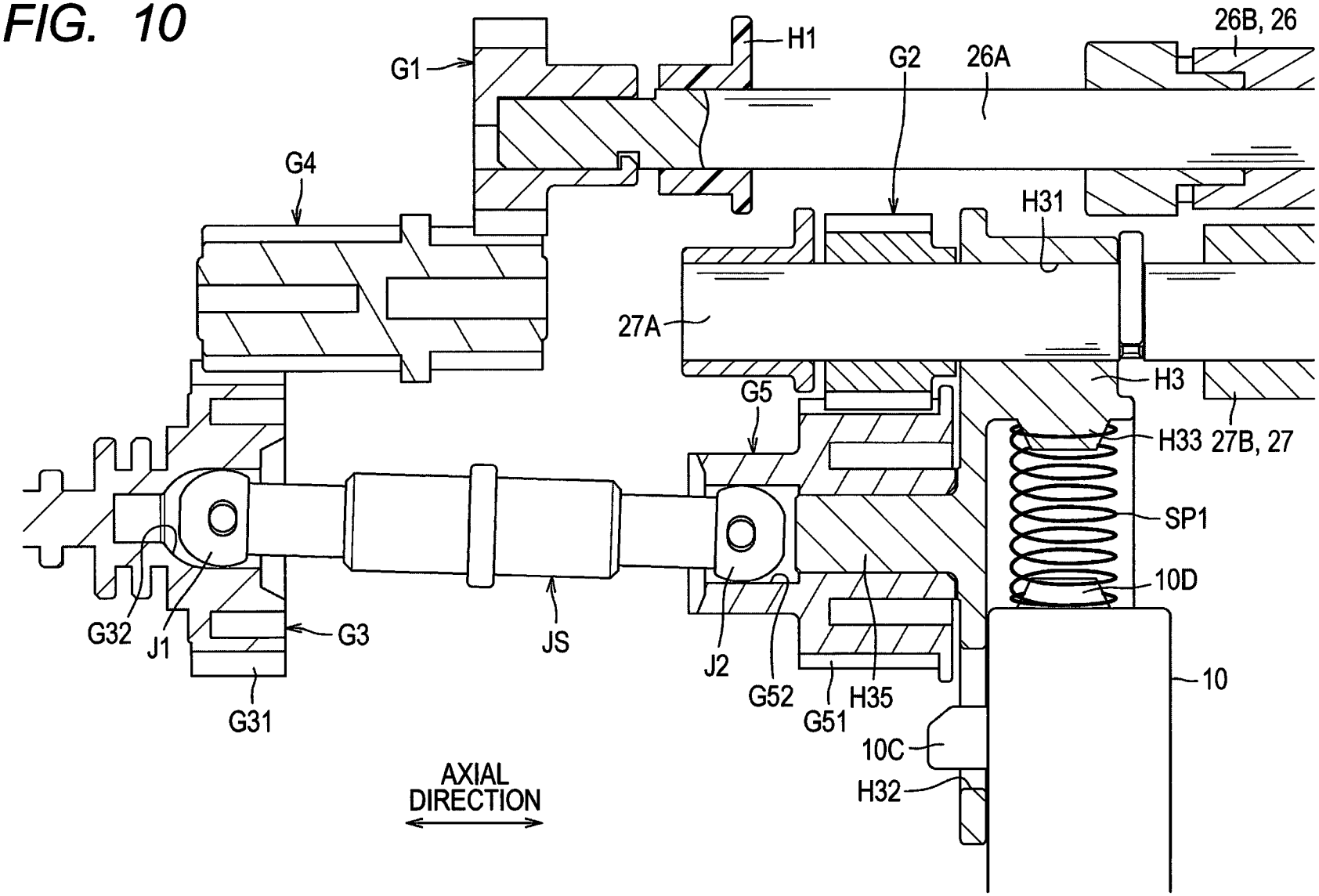
FIG. 10 is a cross-sectional view showing a state where the first roller and the second roller are farther separated from each other than the state of FIG. 9.

The other end J2 fits in the second recess G52 and is connected to the first idle gear G5. As a result, the other end J2 forms a universal joint together with the second recess G52. With such a configuration, as shown in FIG. 10, when printing images on thick paper and so on, even if the second roller 27 is lowered relative to the first roller 26, and the joint shaft JS is inclined relative to the axial direction of the drive gear G3, the driving force of the driving gear G3 is transmitted to the second gear G2.

According to the above, the following operations and effects are obtained in the present embodiment.

As shown in FIG. 11A, according to the image forming apparatus 1 of the present embodiment, when the drive gear G3 is rotated by the motor M, the first gear G1 is driven to rotate through the second idle gear G4, and the first roller 26 rotates. On the other hand, when the drive gear G3 rotates, the first idle gear G5 is driven to rotate through the joint shaft JS, the driving force is transmitted from the first idle gear G5 to the second gear G2, and the second gear G2 and the second roller 27 rotate.

At this time, since the first gear G1 is driven not through the second gear G2, and the second gear G2 is driven not through the first gear G1, the first gear G1 and the second gear G2 do not receive reaction force from each other. The second gear G2 is movable up and down relative to the first gear G1. Thus, if the first gear G1 and the second gear G2 are directly engaged with each other, and the second gear G2 receives a reaction force from the first gear G1 as in the comparative example shown in FIG. 11B, second gear G2 may be pushed down. However, in the image forming apparatus 1 of the present embodiment, since the image forming apparatus 1 does not receive such a reaction force, it is possible to prevent the contact pressure between the first roller 26 and the second roller 27 from becoming non-uniform, and prevent the sheet S conveyed to the image forming unit 30 from skewing.

Figure 11B:
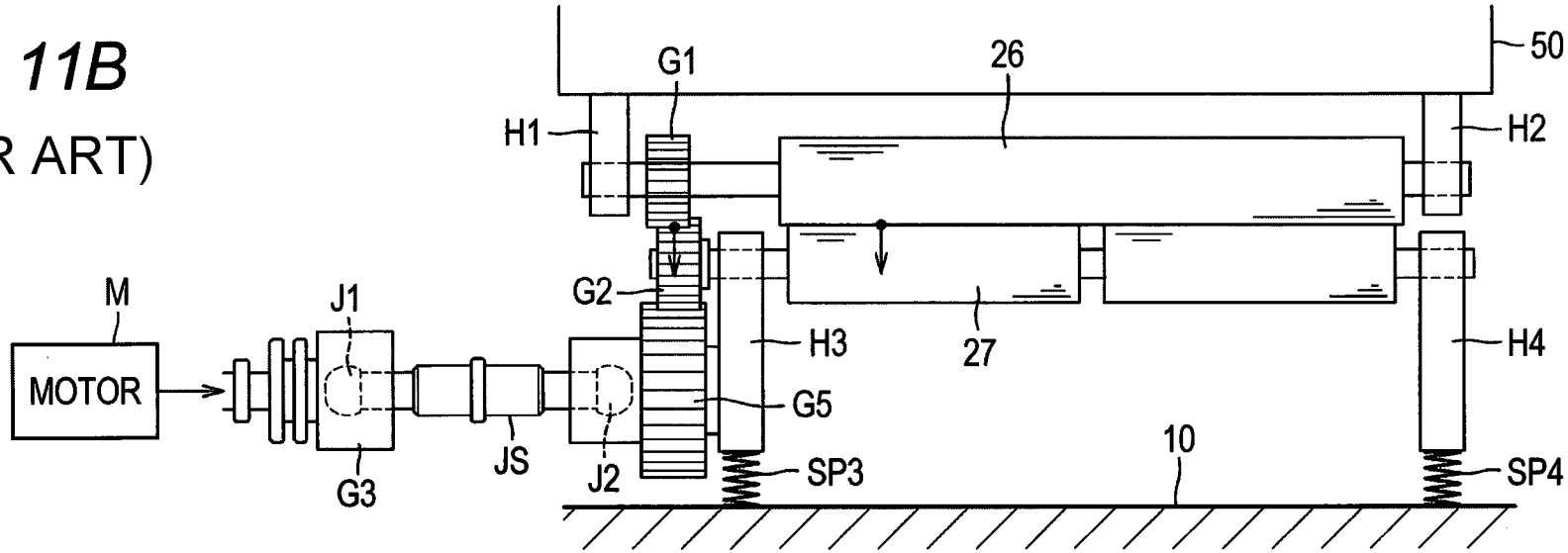
FIG. 11B (PRIOR ART)

In order to make the contact pressure between the first roller 26 and the second roller 27 uniform, in the comparative example in FIG. 11B, the urging force of an urging member SP3 at the second gear G2 side may be made stronger than the urging force of another urging member SP4. However, it is difficult to set the contact pressure to be uniform to correspond to the sheets S having various thicknesses.

According to the image forming apparatus 1 of the present embodiment, since the same parts are used for the pair of urging members SP1 (that is, the pair of urging members SP1 have the same urging force), it is possible to set the contact pressure to be uniform to correspond to the sheets S having various thicknesses as compared with the example of FIG. 11B.

Note that the second gear G2 receives a reaction force in the radial direction from the first idle gear G5. However, since both the second gear the second gear G2 and the first idle gear G5 are supported by the bearing H3, the reaction force generated between G2 and the first idle gear G5 is received by the bearing H3 between the portion of the shaft hole H31 and the shaft portion H35 (see FIG. 9). That is, since the bearing H3 does not receive a downward force from the outside as in the example of FIG. 11B, the reaction force generated between the second gear G2 and the first idle gear G5 does not affect the contact pressure between the first roller 26 and the second roller 27.

The joint shaft JS constituting the second drive transmission part transmits the driving force of the drive gear G3 to the second gear G2 even if the joint shaft JS is inclined relative to the axial direction of the drive gear G3. Thus, even if the second roller 27 moves such that the distance between the axis of the first roller 26 and the axis of the second roller 27 is changed, the driving force is transmitted from the drive gear G3 to the second gear G2.

Since the one end J1 of the joint shaft JS is located inside the gear teeth G31 of the drive gear G3 in the radial direction, the joint shaft JS can be made long. Thus, even if the second roller 27 moves such that the distance between the axis of the first roller 26 and the axis of the second roller 27 is changed, the inclination of the joint shaft JS relative to the axial direction of the drive gear G3 is suppressed. As a result, the speed fluctuation in the drive between the drive gear G3 and the second gear G2 is suppressed.

The second drive transmission part holds the second gear G2 and the first idle gear G5, and has the bearing H3 as a gear holder that is movable relative to the first roller 26. Thus, due to the gear holder H3, the first idle gear G5 and the second gear G2 can be integrally moved relative to the first roller 26.

The second idle gear G4 urges the drawer 50 in the direction opposite the opening 10A when transmitting the driving force to the first gear G1. Thus, it is possible to prevent the drawer 50 from moving toward the opening 10A, and the position of the drawer 50 relative to the main housing 10 is stable.

While the disclosure has been described in detail with reference to the above aspects thereof, it would be apparent to those skilled in the art that various changes and modifications may be made therein without departing from the scope of the claims.

In the above embodiment, the first drive transmission part is composed of one idle gear. However, the first drive transmission part may have a configuration having a plurality of idle gears, or may have a transmission member other than the idle gear.

In the above embodiment, the second drive transmission part is composed of one idle gear and one joint shaft. However, the second drive transmission part may not have the joint shaft or may have another transmission member.

In the above embodiment, the urging member for urging the second roller toward the first roller is a compression spring. However, the urging member may be a leaf spring, a torsion spring, and so on.

In the above embodiment, the axial direction of the drive gear G3 and the axial direction of the photosensitive drum 51 are the same. However, these directions may be different.

In the above embodiment, the image forming apparatus 1 is a color printer.

However, the present disclosure may be applied to a monochrome printer or another image forming apparatus such as a copier and a multifunction peripheral.

Each element of each of the above-described embodiments and modifications may be implemented in any combination.

What is claimed is:

1. An image forming apparatus comprising:

a print engine;

a first roller;

a first gear arranged at an end of the first roller and rotatable together with the first roller;

a second roller configured to nip a sheet with the first roller and to convey the sheet to the print engine, the second roller being movable so as to change a distance between an axis of the first roller and an axis of the second roller;

a second gear arranged at an end of the second roller and rotatable together with the second roller;

an urging member configured to urge the second roller toward the first roller;

a motor;

a drive gear having gear teeth, the drive gear being rotatable by receiving driving force from the motor;

a first drive transmission part configured to transmit driving force from the drive gear to the first gear not through the second gear; and a second drive transmission part configured to transmit driving force from the drive gear to the second gear not through the first gear, wherein the second drive transmission part includes a joint shaft having end portions forming universal joints at both ends;

wherein one of the end portions of the joint shaft is coupled to the drive gear; and wherein the joint shaft is configured to transmit the driving force of the drive gear to the second gear in a state where the joint shaft is inclined relative to an axial direction of the drive gear.

2. The image forming apparatus according to claim 1, wherein the drive gear has a recess into which one of the end portions of the joint shaft fits; and wherein the one of the end portions of the joint shaft is located inside of the gear teeth of the drive gear in a radial direction.

3. The image forming apparatus according to claim 1, wherein the second drive transmission part includes:

an idle gear engaging the second gear, the idle gear having a recess coupled to an other one of the end portions of the joint shaft; and a gear holder holding the second gear and the idle gear, the gear holder being movable relative to the first roller.

4. The image forming apparatus according to claim 1, further comprising:

a main housing; and a drawer movable between a first position inside the main housing and a second position outside the main housing, wherein the first roller is provided at the drawer; and wherein the second roller is provided at the main housing.

5. The image forming apparatus according to claim 4, wherein the main housing has an opening through which the drawer is mounted;

wherein the first drive transmission part includes an idle gear directly engaging the first gear; and wherein the idle gear urges the drawer in a direction opposite the opening when the idle gear transmits driving force to the first gear.

6. The image forming apparatus according to claim 1, wherein the urging member includes a pair of springs configured to urge both ends of the second roller in an axial direction toward the first roller, the pair of springs having same urging force.

7. The image forming apparatus according to claim 1, wherein the first roller and the second roller serve as a pair of registration rollers configured to regulate a leading end of a sheet in a state where rotation is stopped and then rotate so that the sheet is supplied to the print engine.

8. An image forming apparatus comprising:

a print engine;

a first roller;

a first gear arranged at an end of the first roller and rotatable together with the first roller;

a second roller configured to nip a sheet with the first roller and to convey the sheet to the print engine, the second roller being movable so as to change a distance between an axis of the first roller and an axis of the second roller;

a second gear arranged at an end of the second roller and rotatable together with the second roller;

an urging member configured to urge the second roller toward the first roller;

a motor;

a drive gear having gear teeth, the drive gear being rotatable by receiving driving force from the motor;

a first drive transmission part configured to transmit driving force from the drive gear to the first gear not through the second gear; and a second drive transmission part configured to transmit driving force from the drive gear to the second gear not through the first gear, wherein the first gear is located between the drive gear and the second gear in an axial direction of the drive gear.

9. An image forming apparatus comprising:

a print engine;

a first roller;

a first gear arranged at an end of the first roller and rotatable together with the first roller;

a second roller configured to nip a sheet with the first roller and to convey the sheet to the print engine, the second roller being movable so as to change a distance between an axis of the first roller and an axis of the second roller;

a second gear arranged at an end of the second roller and rotatable together with the second roller;

an urging member configured to urge the second roller toward the first roller;

a motor;

a drive gear having gear teeth, the drive gear being rotatable by receiving driving force from the motor;

a first drive transmission part configured to transmit driving force from the drive gear to the first gear not through the second gear; and a second drive transmission part configured to transmit driving force from the drive gear to the second gear not through the first gear, wherein the first roller has a roller portion that nips a sheet with the second roller;

wherein the image forming apparatus further includes a bearing rotatably supporting the first roller; and wherein the bearing is located between the first gear and the roller portion of the first roller.

* * * * *